United States Patent [19]

Kramer

[11] 4,095,438

[45] Jun. 20, 1978

[54] REFRIGERATION SYSTEM WITH HOT GAS DEFROST

[76] Inventor: Daniel E. Kramer, 2009 Woodland Dr., Yardley, Pa. 19067

[21] Appl. No.: 774,480

[22] Filed: Mar. 4, 1977

[51] Int. Cl.[2] ..... F25B 47/00

[52] U.S. Cl. ..... 62/278

[58] Field of Search ..... 62/278, 155

[56] References Cited

U.S. PATENT DOCUMENTS

| | | | |
|---|---|---|---|
| 3,071,935 | 1/1963 | Kapeker | 62/278 |
| 3,427,819 | 2/1969 | Seghetti | 62/278 |
| 3,677,025 | 7/1972 | Payne | 62/278 |
| 3,822,562 | 7/1974 | Crosby | 62/278 |
| 3,839,879 | 10/1974 | Redfern et al. | 62/278 |

*Primary Examiner*—Lloyd L. King
*Attorney, Agent, or Firm*—Daniel E. Kramer

[57] ABSTRACT

A refrigeration system having compressor and condenser adapted for operation in ambients above approximately 45° F (7° C) and including a frosting evaporator. The evaporator is defrosted by hot gas which flows through the compressor discharge, the condenser, the receiver, the liquid line and a valve-controlled hot gas branch connected between the liquid line and the hot gas inlet of the evaporator. During defrost, a control stops the evaporator and condenser fan motor and opens the valve in the hot gas branch conduit. At defrost's end, the control causes the evaporator and condenser fan motor to operate and the hot gas valve to close so that liquid refrigerant flows from the condenser outlet through the receiver and liquid line to the expansion device which feeds the evaporator for refrigeration in the normal course.

6 Claims, 2 Drawing Figures

REFRIGERATION SYSTEM WITH HOT GAS DEFROST

FIELD OF THE INVENTION

This invention relates to the field of mechanical refrigeration and the application of the refrigeration to cool spaces at or below 45° F, such as 32° F (0° C), 0° F (−18° C) or −20° F (−29° C). More particularly, the field of the invention relates to those mechanical refrigeration systems whose compressor, condenser and a portion of the suction line is exposed to ambients of 45° F (7° C) or higher.

The field is further defined as those systems satisfying the above requirements but where the evaporator is periodically warmed by a defrosting system which includes the step of supplying refrigerant vapor from the compressor to the evaporator for the purpose of warming it above the thawing point of the frost, which is 32° F (0° C), causing the frost to thaw and drain away to waste.

Prior Art

Mechanical refrigeration system having frosting evaporators which are defrosted by hot gas have been known for many years. The systems known to this inventor have all used a hot gas line which bypassed the condenser and, in some cases, the receiver and liquid line, and routed the hot gas directly from the compressor discharge to the evaporator, or from the compressor discharge to the condenser outlet to the evaporator. Known refrigeration systems which direct the hot gas into the suction line, thereby using the suction line in a reverse flow direction to convey the hot gas to the evaporator are not considered to be prior art since the instant system is not directed toward the use of the suction conduit for the conveyance of gas to the evaporator for the purpose of defrosting it.

BRIEF DESCRIPTION OF THE INVENTION

The invention is an improved refrigeration system including compressor, condenser, receiver and a refrigerating evaporator which accumulates frost on its surfaces. On demand of a timer, defrost is provided by hot gas from the compressor traversing the same path taken by the refrigerant during refrigeration: from the compressor through the condenser (with its coolant flow stopped), receiver and liquid line seriatim. Instead of flowing through the highly restricted expansion device during defrost, a hot gas line is provided bypassing the expansion device and delivering hot gas directly from the liquid line, near the expansion valve inlet, to the evaporator, traversing a drain pan heating coil on the way to the evaporator. The liquid refrigerant leaving the evaporator is trapped by a suction accumulator and metered into the suction line where it is evaporated before its eventual return to the compressor.

Using this invention, an ordinary refrigeration condensing unit can be made to serve as a refrigerating and hot gas defrost condensing unit without any internal connection to the condensing unit pipes.

DETAILED DESCRIPTION OF THE DRAWINGS

Figure 1:
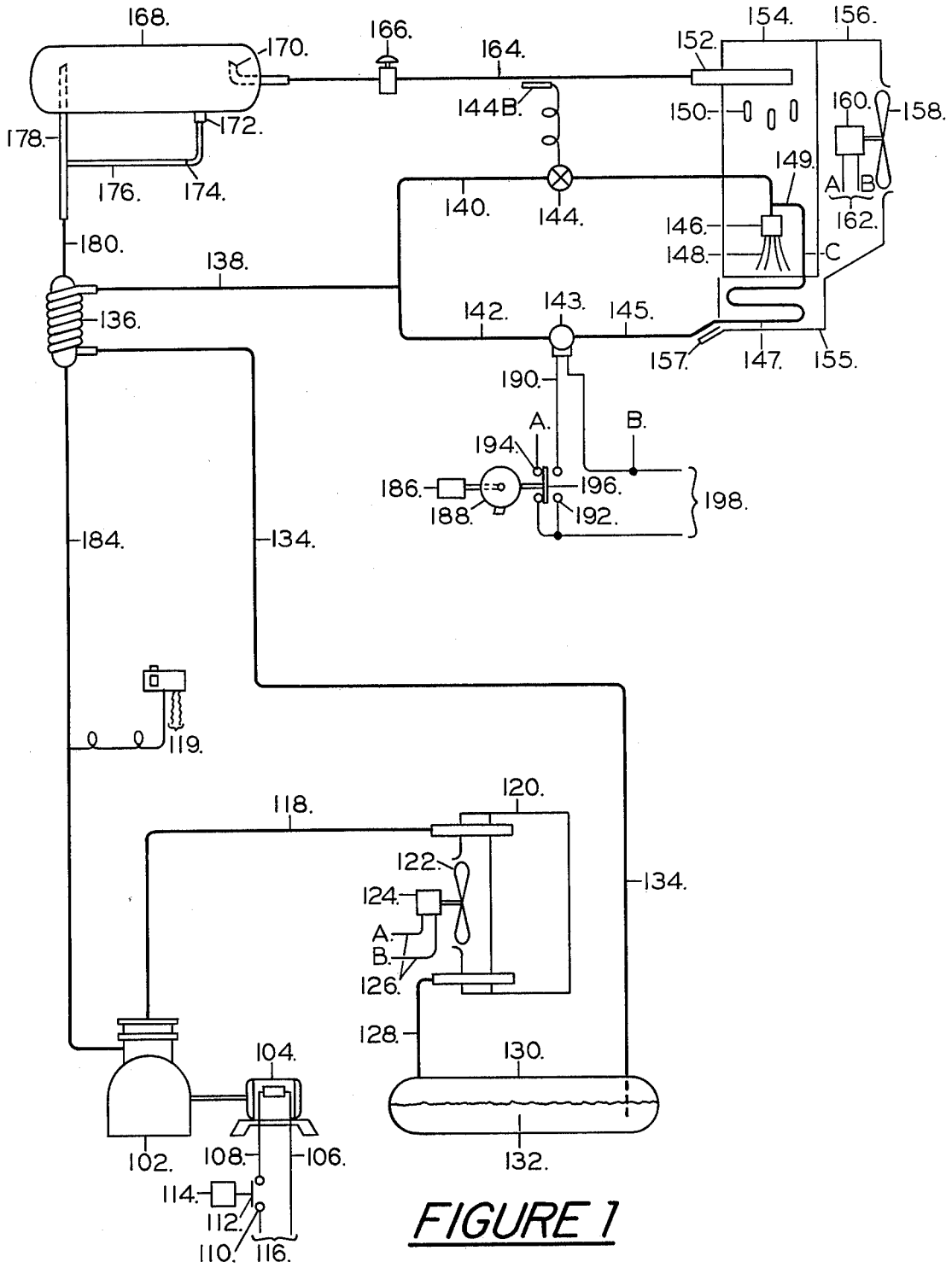
FIG. 1 shows a refrigeration system having an air cooled condenser, a receiver and a liquid line through which refrigerant flows both during refrigeration and defrosting cycles.

FIG. 1 shows a refrigeration system embodying the principle of the invention. During refrigeration, compressor 102 withdraws vapor from suction line 184 and discharges it, compressed to higher pressure, into discharge line 118, which, in turn, conveys the now compressed and high temperature refrigerant to condenser 120. In condenser 120, which is cooled by air drawn over it by fan 122, driven, in turn, by motor 124, the refrigerant vapor is cooled and condensed to a liquid which flows through condenser outlet conduit 128 into receiver 130 where the liquid refrigerant collects in pool 132. As required by the needs of the system, liquid refrigerant is withdrawn from pool 132 via liquid line 134 and flows to expansion valve 144 by way of the liquid conduit traversing the suction-liquid heat exchanger 136/182. The liquid is further cooled in this heat exchanger by heat exchange with the cooled vapor leaving the suction accumulator 168. This cooled liquid traverses conduit 138 and conduit 140 and then enters expansion valve 144, where its pressure is reduced to evaporator pressure. The operation of expansion valve 144 is controlled by its bulb 144B which is connected to the pressure element on the expansion valve 144 by a capillary tube. The bulb 144B is strapped to suction line 164, connected to the suction outlet 152 of the evaporator 154. The liquid refrigerant metered by the expansion valve 144 now flows through distributor 146, which divides the refrigerant flow into equal quantities which are delivered to the distributing tubes 148. Each quantity of refrigerant traverses the refrigerating coil 154 and is evaporated to dryness by way of picking up heat from the air which is drawn over the coil by evaporator fan 158, driven in turn by evaporator fan motor 160. The evaporator fan motor has leads 162 which are connected to the time clock 186, as will be described later. The vapor from the evaporator outlet 152 traverses suction line 164, outlet pressure regulating valve 166, suction accumulator 168, suction line 180, suction heat exchanger 136/182 and suction line 184 to return to the compressor. As the cool suction vapor traverses the suction liquid heat exchanger 136/182, it is warmed, at the same time cooling the liquid refrigerant traversing the other passage.

During the refrigerating period, timer cam 188 is in a position such that switch lever 196 closes contacts 194. The evaporator fan motor has leads A and B, connected to points A and B on the timer schematic. The condenser fan motor 124 also has leads A and B which are also connected to terminals A and B on the timer schematic. So long as the timer is calling for refrigeration, terminals A and B will be energized and condenser fan motor 124 and the evaporator fan motor 160 will operate. Though not shown, the condenser fan motor 124 may simultaneously be connected in such a way that it is deenergized and the fan motor stopped at the same time that the compressor motor 104 is deenergized and stops. When fan motors 124 and 160 are energized, hot gas solenoid 143 is deenergized. When timer motor 186 turns cam 188 so that the elevated portion causes switch element 196 to open contacts 194 and close contacts 192, the removal of power from terminal A of the timer causes the evaporator fan motor 160 and the condenser fan motor 124 to stop operation. Simultaneously the closing of timer contact 192 causes the hot gas solenoid 143 to be energized and to open. At that moment, the pressure on the high side drives all the liquid residing in condenser 120, receiver 130, and liquid line 134 into the evaporator coil 154. As the compressor continues to operate, and gas flows through discharge line 118, condenser coil 120, receiver 130 and liquid line 134, this body of liquid is driven out of the evaporator 154 into suction line 164 and through holdback valve 166 into suction accumulator 168, where it is trapped. The vapor, driven by the compressor, which follows the liquid, leaves liquid line 138 by way of hot gas branch conduit 142 and enters the hot gas heating coil 147 through the now open hot gas solenoid valve 143. The heating coil 147 is located in evaporator drain pan 155, which is in turn located directly under the frost-laden evaporator coil 154. After the hot gas traverses pan heating coil 127 and warms the drain pan 155, it flows via conduit 149 into distributor 146 and is distributed essentially equally through distributor tubes 148 to the evaporator coil 154 with its tubular passes 150. As the gas from the compressor performs its heating function in the evaporator, raising the evaporator temperature and causing the frost to thaw, it condenses to a liquid, simultaneously raising the pressure within the evaporator. The liquid is driven out of the evaporator as it is formed and into suction line 164 through holdback valve 166 and into suction accumulator 168 where it is collected. The refrigerant liquid collected in accumulator 168 lies in a pool at the bottom. Small amounts of this liquid refrigerant are continuously metered out of the bottom of accumulator 168 through liquid outlet conduit 172 and metering orifice 174 through conduit 176 and into suction line 180. During the course of the defrost, hot gas instead of liquid traverses liquid line 134. In doing so it also traverses the heat exchange passage on the liquid side of heat exchanger 136/182. In traversing this path, the hot gas gives up some of its heat to the small amount of liquid refrigerant which had been metered out of the suction accumulator 168, evaporating it essentially to dryness. The suction vapor now traverses suction line 184 by which it returns to the compressor 102 for recycling through the defrost operation. Holdback valve 166 is adjusted to produce an outlet pressure no higher than that which would cause a horsepower consumption of compressor 102 which motor 104 can develop. When timer motor 186 has caused cam 188 to rotate through the defrost cycle, switching element 196 causes contacts 192 open and completes the circuit of contacts 194, restoring the system to refrigeration operation. Although not shown, and not required as part of this invention, more elaborate systems may use thermostats, timers or pressure switches to delay the beginning of the operation of fan 158 until the pressure or the temperature in evaporator 154 has been reduced to a value approaching the normal refrigeration conditions. At the end of the defrost period, there may be considerable liquid trapped in accumulator 168. This refrigerant liquid continues to drain under the metering control of orifice 174 into suction line 180 and is reevaporated now by the warm liquid refrigerant flowing in heat exchange relation thereto by way of the liquid passage 136 in heat exchanger 136/182.

In this system a hot gas defrost has been achieved without the use of a hot gas line and without any separate hot gas connection being made in the discharge line 118 of the condensing unit combination comprising compressor 102, compressor motor 104, condenser 120 and receiver 130. In fact, the entire defrost assembly, comprising the timer, the evaporator, the expansion valve, the holdback valve, the suction accumulator and the suction liquid heat exchanger, could be packaged into a single unit, shipped to the job site, hung in place within the cooler or freezer, and connected for operation by running a suction and a liquid line from the condensing unit and connecting the condenser fan motor leads to the timer terminal. This is by contrast to the usual refrigeration systems having hot gas defrost, which require cutting discharge line 118 for the purpose of installing a tee and running a third conduit for the separate conveyance of hot gas.

The above system, as described, operates correctly with its high side and suction line exposed to an ambient temperature of 45° or higher. It is entirely possible that the system will refrigerate and defrost correctly at ambient temperatures below +45° F, but at the time of this aplication, neither field nor laboratory tests have disclosed the bottom operating temperature limit at which some malfunction, either in refrigeration or defrost, occurs.

Figure 2:
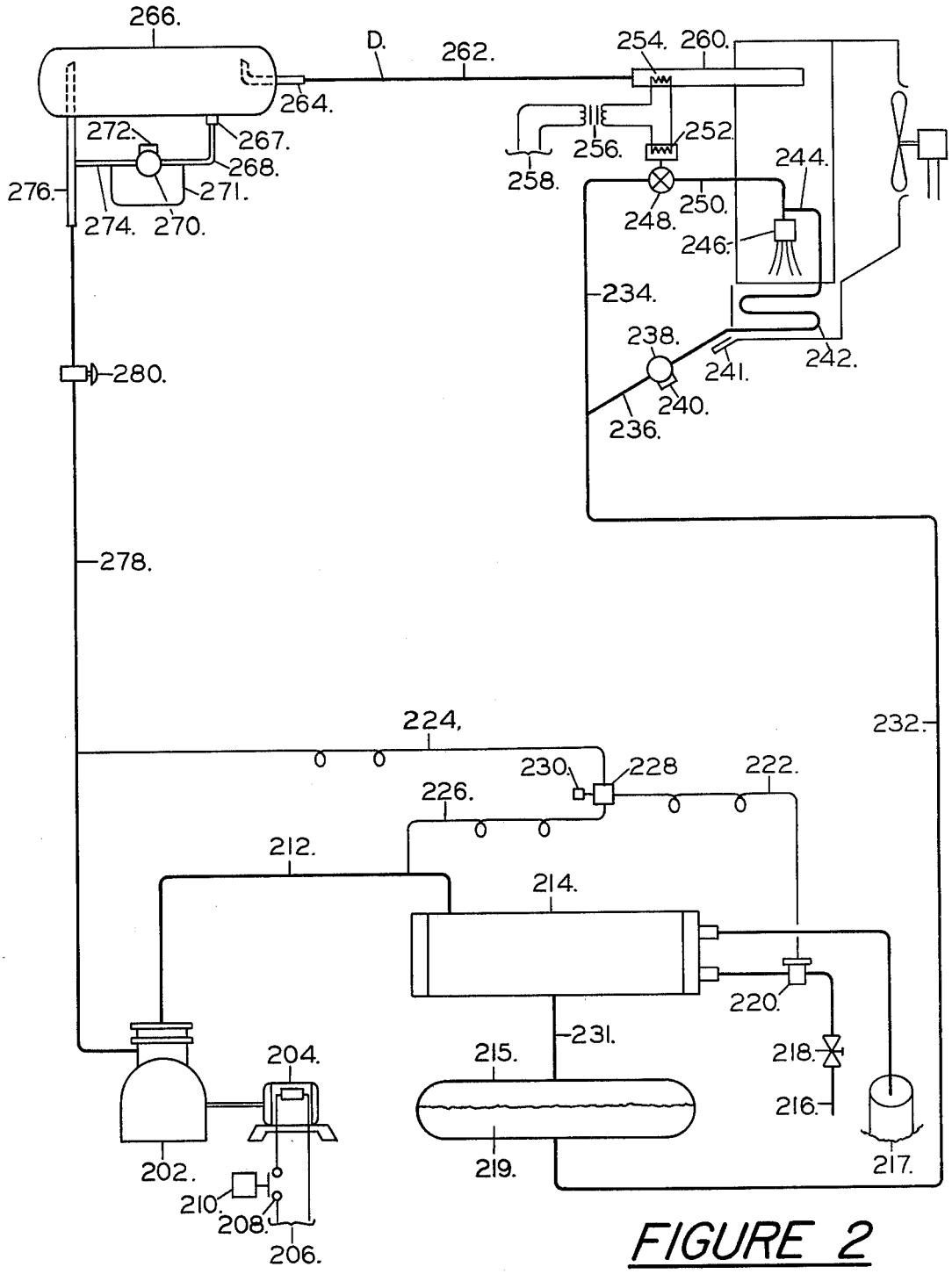
FIG. 2 shows a refrigeration system having a water cooled condenser and a water flow control valve, a receiver and liquid line through which refrigerant flows, both during the refrigeration and the defrost cycles.

The system in FIG. 2 is similar to that of FIG. 1, except a water cooled condenser with water regulating valve has been substituted for the air cooled condenser. An electric expansion valve has been substituted for the thermostatic expansion valve at the evaporator inlet. The liquid outlet conduit of the suction accumulator is valve-controlled. There is no suction liquid heat exchanger and the holdback valve is installed on the outlet side of the suction accumulator. The system operates as follows: during refrigeration, compressor 202 withdraws vapor from suction line 278 and discharges it at a high pressure to discharge line 212. The discharge line conveys the hot, high pressure vapor to the condenser 214 where the vapor flows in heat exchange relationship to water taken from supply line 216 and metered into the tubes of the water cooled condenser by water regulating valve 220. Water regulating valve 220 is a pressure sensing valve whose pressure sensing line 222 can be connected either to the compressor discharge line 212 by way of conduit 226 or, in the alternative, to the suction conduit 278 via conduit 224. The decision as to which pressure source is utilized depends on the condition of 3-way valve 228. When coil 230 of 3-way valve 228 is energized, the interior components of valve 228 are shifted so that pressure conduit 222 is connected to pressure conduit 226 and thereby connected to sense the high side pressure of the system. In this mode, as the valve 220 feeds more water and the high side pressure is caused to drop, the valve senses the drop in pressure and reduces the water flow so that the pressure in the system high side is regulated to a predetermined value and the consumption of water is not excessive. When the system is shut down, the pressure in the system high side is reduced because compressor 202 stops operation. The valve 220 senses this drop in pressure and thereupon closes, stopping the flow of water through water-cooled condenser 214 so that no water is wasted.

While the compressor 202 is in operation, however, and water is being fed through regulating valve 220, the refrigerant vapor is condensed in condenser 214 to a liquid and traverses liquid conduit 231 to receiver 215, in which it collects as a pool 219. On the demand of the expansion valve 248, liquid refrigerant is withdrawn from the receiver 215 and flows through liquid line 232 and branch liquid line 234 into the electric expansion valve 248. Electric expansion valves are well known in the art and utilize a thermistor which is immersed in the suction outlet of the evaporator and heated by a low voltage flow of current supplied by a transformer 256. So long as only vapor is in contact with the thermistor 254, located in the suction stream, the thermistor is hot and its resistance low. This low resistance allows substantial current to flow, causing the heater 252 to sharply affect bimetal, not shown, in the expansion valve 248 biasing it toward an open position. When sufficient refrigerant is fed into the evaporator so that some overspills the suction outlet and comes in contact with sensor 254, the sensor is chilled by virtue of the high film coefficient which develops between the sensor 254 and the liquid refrigerant. The thermistor 254 has a high resistance when it is chilled and sharply reduces the flow of current to heater 252 located in thermal contact with bimetal element which is in the thermal expansion valve 248. As the bimetal cools, it biases the valve 248 to a closed position, reducing the flow of refrigerant to the evaporator. The use of an electric expansion valve in a system of this type is desirable because it allows a completely pre-assembled package to be sold which is suitable for any halocarbon refrigerant without the need for changing thermostatic expansion valve element as would be required if an ordinary thermal expansion valve were employed in this application.

The liquid refrigerant fed by the expansion valve into the evaporator is distributed through distributor 246 and evaporated to dryness by cooling the air drawn over the fin pack of the evaporator and is circulated back to the compressor through suction line 262, accumulator 266, holdback valve 280 and suction line 278.

In FIG. 2, during defrost, the timer of FIG. 1 stops the evaporator fan motor and opens solenoid valve 238. At the same time, it deenergizes coil 230 of 3-way valve 228, causing pressure sensing line 222 to be connected to conduit 224. Conduit 224 senses low side pressure and valve 220, being connected thereto, also senses low side pressure. Since valve 220 is designed to close whenever it senses a pressure lower than its setting and since the pressure in low side conduit 278 is much lower than its setting, valve 220 closes off completely, positively stopping the flow of any cooling water through the water cooled condenser 214. Therefore, discharge vapor 212 flows through the condenser 214 without being cooled substantially and blows the liquid refrigerant 219 and the liquid collected in liquid line 232 through the evaporator and into the suction accumulator 266. The liquid is immediately followed by the warm suction vapor which has been discharged by the compressor but not substantially cooled or condensed in the water cooled condenser. This vapor serves to warm and raise the pressure within the evaporator, causing the frost which had collected on its fins to reach 32° (0° C), thaw, flow into the drain pan and out into the drain. In the course of the warm refrigerant flowing from the liquid line 232 through the hot gas branch 236 and the open hot gas solenoid 238 into the evaporator through the drain pan heating coil 242 and warming the evaporator, it condenses, at least partially, to a liquid. This liquid is conveyed along with its parent vapor through suction line 262 and into the suction accumulator 266, where the liquid refrigerant is separated from the vapor. The liquid refrigerant falls into a pool at the bottom of suction accumulator 266, while the vapor traverses the suction outlet tube 276 on its way to the compressor. Since the pressure in the accumulator 266 rises during the course of defrost, holdback valve 280 acts to throttle the pressure and control the pressure in suction conduit 278 to a level which the compressor 202 and its driving motor 204 can tolerate without overloading or damage. At the same time that the timer causes the hot gas solenoid 238 to open, it also energizes coil 272 of the normally open solenoid valve 270, which is located in the liquid drain conduit 268/274 of the suction accumulator 266. When coil 272 is energized, it causes valve 270 to close. Valve 270 is bypassed by a metering tube 271 which is selected with an internal diameter sufficiently small that the refrigerant liquid which flows through it is sufficiently small in quantity that it can be completely evaporated to a vapor by heat transfer contact with the ambient air surrounding suction line 278.

As soon as the temperature of the evaporator has risen sufficiently high to cause all of the frost to thaw and flow to drain, the timer, of FIG. 1, terminates the defrost by closing solenoid 238 and energizing 3-way valve 228 so that the point of connection of the pressure sensing element of the water regulating valve 220 is changed from the suction pipe 278 to the discharge pipe 212 of the system. With the gas flow to the evaporator stopped by closing of valve 238, the evaporator pressure begins to drop as gas is removed therefrom under the control of pressure regulating valve 280. A pressure switch, not shown, is provided to sense the pressure in the evaporator-accumulator subassembly when the pressure in the subassembly has dropped to a preset level, indicating that the amount of liquid refrigerant in accumulator 266 has been reduced to a negligible level, the evaporator fan is restarted and the coil 272 of solenoid valve 270 is deenergized, allowing valve 270 to open, so that free flow of oil out of the accumulator can occur from the bottom of the accumulator 266 into the suction outlet 276 of the accumulator and from there back to the compressor for normal lubrication and restoration of the oil level in the compressor crankcase.

By the use of this invention any ordinary air cooled or water cooled condensing unit intended primarily for indoor application can be applied as a refrigeration system suitable for hot gas defrosting a remote evaporator. This allows contractors and owners to apply hot gas defrost evaporators with a greater degree of reliability, rapidity of defrost, and therefore, refrigerating efficiency without being limited by the availability of condensing units otherwise specifically designed for hot gas defrost, as has been required by the current state of the refrigerating art.

I claim:

1. An improved refrigeration system having refrigerating and defrosting periods, said system comprising:

a. compressor;

b. condenser;

c. a discharge conduit connecting the compressor to the condenser, the compressor and condenser constituting a refrigeration highside;

d. evaporator, including suction conduit means for conveying refrigerant from the evaporator to the compressor;

e. expansion means positioned substantially adjacent the evaporator, for restrictedly feeding liquid refrigerant to the evaporator during refrigerating periods;

f. liquid conduit means for connecting the condenser to the expansion device, wherein the improvement comprises:

1. hot gas conduit means connecting a point in said liquid conduit means substantially adjacent the inlet of the expansion device to the evaporator for defrosting the evaporator by hot gas which has traversed the condenser and the liquid conduit means; and
2. means in the suction conduit means for limiting the rate of refrigerant circulation through said liquid conduit means during defrost;

whereby both the refrigerating and the hot gas defrosting functions are achieved with only two conduits joining the highside.

2. A refrigeration system as in claim 1 where the refrigerant circulation limiting means includes control means for limiting the rise in pressure at the compressor inlet during defrost periods.

3. A refrigeration system as in claim 1 which includes liquid receiver means located adjacent to the condenser and connected to the liquid conduit means.

4. A refrigeration system as in claim 1 which includes a suction accumulator in the suction conduit means.

5. A refrigeration system as in claim 1 which includes heat exchange means located in the suction conduit means for transferring heat from warm liquid to the suction stream during refrigerating cycles and from warm gas to the suction stream during defrosting cycles

6. A refrigeration system as in claim 5 which further includes a suction accumulator where the heat exchange means is positioned in the suction conduit means between the accumulator and the compressor.

* * * * *